US011512530B2

(12) United States Patent
Lu

(10) Patent No.: US 11,512,530 B2
(45) Date of Patent: Nov. 29, 2022

(54) ROLLER BLIND DRIVING DEVICE WITH MOTOR IN UPPER BEAM

(71) Applicant: Ningbo Zhenfei Decorated Curtain Co., Ltd., Zhejiang Province (CN)

(72) Inventor: Jiefei Lu, Zhejiang Province (CN)

(73) Assignee: Ningbo Zhenfei Decorated Curtain Co., Ltd., Zhejiang Province (CN)

( * ) Notice: Subject to any disclaimer, the term of this patent is extended or adjusted under 35 U.S.C. 154(b) by 0 days.

(21) Appl. No.: 17/510,374

(22) Filed: Oct. 25, 2021

(65) Prior Publication Data

US 2022/0042373 A1 Feb. 10, 2022

(30) Foreign Application Priority Data

Jul. 28, 2021 (CN) ..... 202121732688.4

(51) Int. Cl.
*E06B 9/70* (2006.01)
*E06B 9/42* (2006.01)

(52) U.S. Cl.
CPC . *E06B 9/70* (2013.01); *E06B 9/42* (2013.01)

(58) Field of Classification Search
CPC ..... E06B 9/70; E06B 9/42; E06B 9/68; E06B 9/40
See application file for complete search history.

(56) References Cited

U.S. PATENT DOCUMENTS 4,951,730 A * 8/1990 Hsu ..... E06B 9/70 160/23.1
2003/0015301 A1* 1/2003 Killo ..... E06B 9/70 160/310
2021/0362822 A1* 11/2021 Brown ..... B64C 1/0009

FOREIGN PATENT DOCUMENTS

CN 211737000 U * 10/2020 ..... E06B 9/42
KR 20140048538 * 4/2014 ..... A47H 23/00

* cited by examiner

*Primary Examiner* — Daniel P Cahn
*Assistant Examiner* — Jeremy C Ramsey
(74) *Attorney, Agent, or Firm* — Yee & Associates, P.C.

(57) ABSTRACT

A roller blind driving device with a motor in an upper beam, the upper beam has a containing cavity, the motor and a pipe coiler body. The motor is installed in the containing cavity of the upper beam; the installation location of the motor in the prior art is improved as the interior of the containing cavity of the upper beam, and the motor is in transmission connection with the pipe coiler body through the transmission structure, so as to apply to pipe coiler bodies with various specifications. The motor with single volume is adopted to reduce the cost of manufacturers.

5 Claims, 4 Drawing Sheets

ROLLER BLIND DRIVING DEVICE WITH MOTOR IN UPPER BEAM

BACKGROUND OF THE INVENTION

The present invention relates to the technical field of curtain accessories, and particularly to a roller blind driving device with a motor in an upper beam.

As one of the indispensable decorations in home and offices, a curtain is mainly used to block the sunlight and achieve an effect of protecting privacy. The traditional curtain often adopts manual control to realize opening and closing of the curtain. However, with the progress of the society, people have higher requirements for intellectualized household experience and more manufacturers also use intellectualized design for the curtain. A pipe coiler of the curtain is driven by a motor for operation, so as to realize opening and closing of the curtain, with effortless operation.

In the prior art, the motor is coaxially arranged on the pipe coiler of the curtain and installed in the pipe coiler of the curtain, but the pipe coiler of the curtain has different diameters. Accordingly, the size of the motor also needs to be changed. When the diameter of the pipe coiler of the curtain needs to be small, the volume of the motor is difficult to be so small, so that the motor cannot be installed in the pipe coiler of the curtain. Due to high price of the motor, the motor with different volumes for needs to be matched for the pipe coiler of the curtain with different diameters, which will increase the cost of the manufacturers.

Based on this, the inventor provides a roller blind driving device with a motor in an upper beam to solve the above technical problems.

BRIEF SUMMARY OF THE INVENTION

In view of the defects of the prior art, the present invention provides a roller blind driving device with a motor in an upper beam. The installation location of the motor in the prior art is improved as the interior of a containing cavity of the upper beam, and the motor is in transmission connection with a pipe coiler body through a transmission structure, so as to apply to pipe coiler bodies with various specifications. The motor with single volume is adopted to reduce the cost of manufacturers.

To solve the above technical problems, the present invention adopts the following technical solution: a roller blind driving device with a motor in an upper beam comprises the upper beam with a containing cavity, the motor and a pipe coiler body, wherein the motor is installed in the containing cavity of the upper beam; an output shaft of the motor is in transmission connection with the pipe coiler body through a transmission structure; a battery for supplying power for the motor is installed in the containing cavity of the upper beam; the battery comprises a lithium battery and a dry battery; the lithium battery is provided with an input wire and a first output wire; the end of the input wire is connected with a charging port; the dry battery is connected with a second output wire; the first output wire and the second output wire are connected with the motor; and the lithium battery and the dry battery can supply power for the motor.

Further preferably, one end of the transmission structure is connected with the output shaft of the motor, and the other end of the transmission structure is connected with a pipe plug with a different specification; and the pipe plug is coaxially connected with the pipe coiler body.

Further preferably, the transmission structure is a gear set; the gear set comprises at least two transmission gears, wherein one transmission gear is coaxially connected with the output shaft of the motor, and the other transmission gear is coaxially connected with the pipe coiler body; and adjacent transmission gears are mutually engaged.

Further preferably, the gear set comprises more than two and an odd number of transmission gears; and the rotation direction of the motor is the same as the rotation direction of the pipe coiler body through the gear set.

Further preferably, the transmission structure is a pulley group; the pulley group comprises a first pulley and a second pulley; the first pulley is coaxially connected with the output shaft of the motor; the second pulley is coaxially connected with the pipe coiler body; and a belt is connected between the first pulley and the second pulley.

Further preferably, the pipe plug is provided with a plurality of ribbed block bars for preventing relative movement between the pipe coiler body and the pipe plug along a circumferential direction.

Further preferably, the side wall of the upper beam is connected with a side plate; one surface of the side plate is provided with the transmission structure, and the pipe plug is detachably installed on another surface of the side plate; and the charging port is arranged on the lower part of the side plate.

The present invention has the following beneficial effects:

1. The installation location of the motor in the prior art is improved as the interior of the containing cavity of the upper beam, and the motor is in transmission connection with the pipe coiler body through the transmission structure, so as to apply to pipe coiler bodies with various specifications. The motor with single volume is adopted to reduce the cost of manufacturers.

2. The pipe plug is detachably arranged on the side plate. The pipe plugs with different diameters can be directly replaced to adapt to the pipe coiler bodies with different sizes. The replacement is convenient and the applicability is wide.

3. The transmission structure includes but not limited to the pulley group and the gear set, wherein the gear set can adopt an odd number of transmission gears and the number of the transmission gears is larger than two. In this way, the rotation direction of the motor can be the same as the rotation direction of the pipe coiler body, which is convenient for controlling the rotation of the pipe coiler body through the motor.

BRIEF DESCRIPTION OF THE DRAWINGS

To more clearly describe the technical solutions in the embodiments of the present invention or in prior art, the drawings required to be used in the description of the embodiments or the prior art will be presented below. Apparently, the technical solutions described in combination with the drawings are merely some embodiments of the present invention, and for those ordinary skilled in the art, other embodiments and drawings can also be obtained according to the embodiments shown by these drawings without contributing creative labor.

DETAILED DESCRIPTION OF THE INVENTION

The technical solutions in the embodiments of the present invention will be clearly and fully described below in combination with the drawings. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
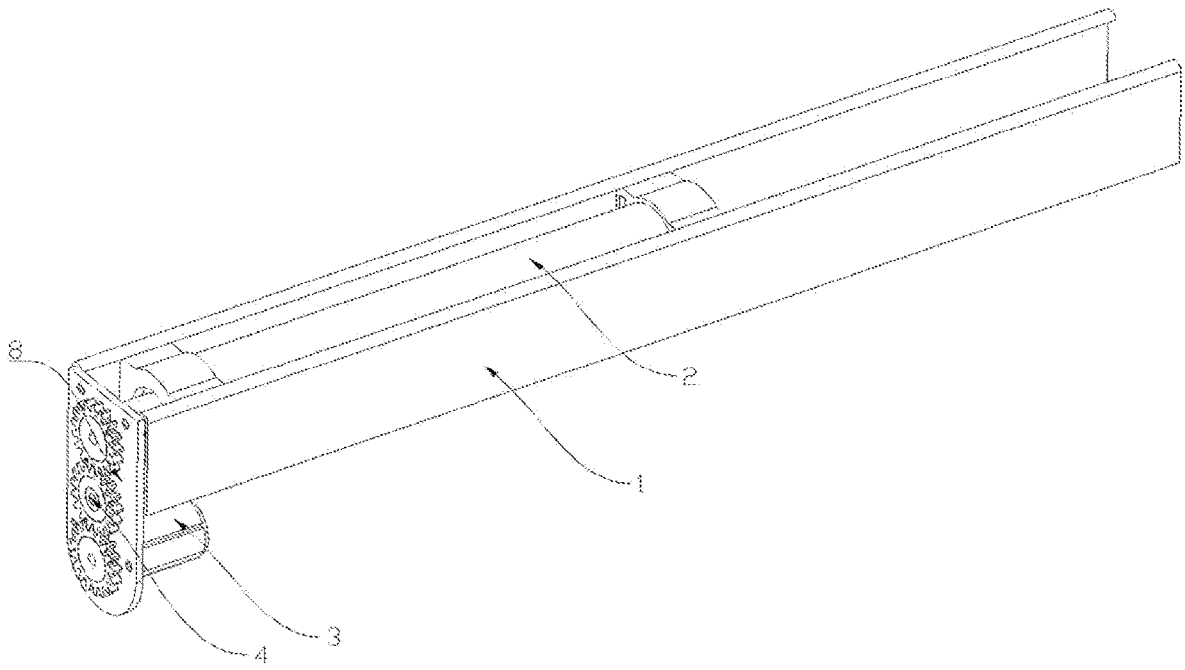
FIG. 1 is a structural schematic diagram of a roller blind driving device with a motor in an upper beam in the present invention.
Figure 2:
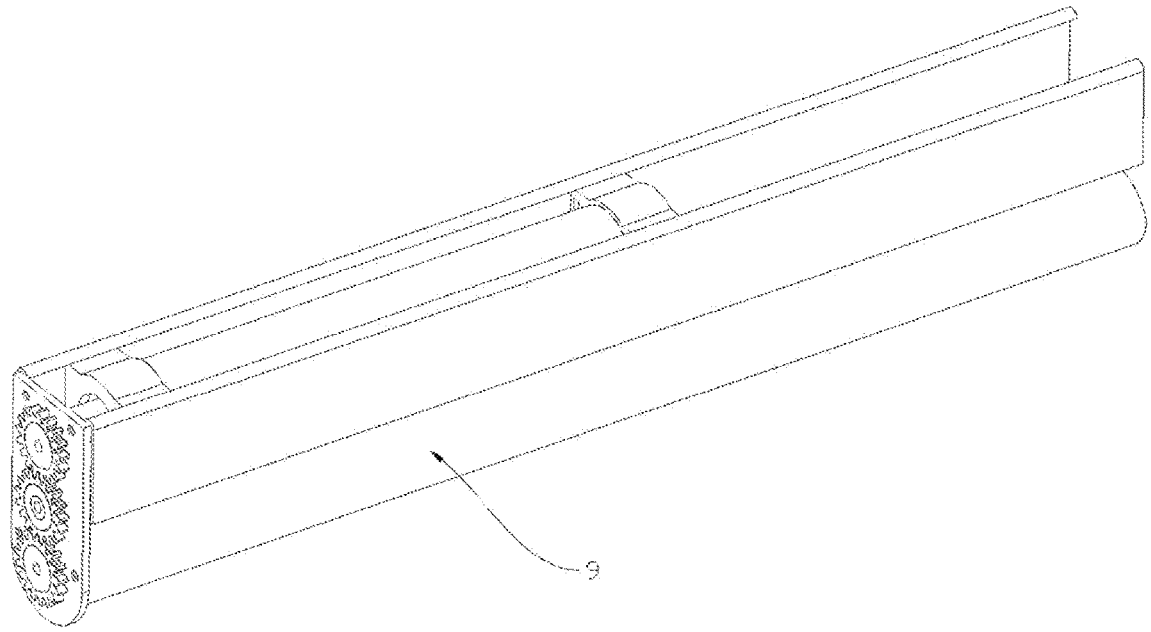
FIG. 2 is a structural schematic diagram of a gear set as a transmission structure in the present invention.
Figure 3:
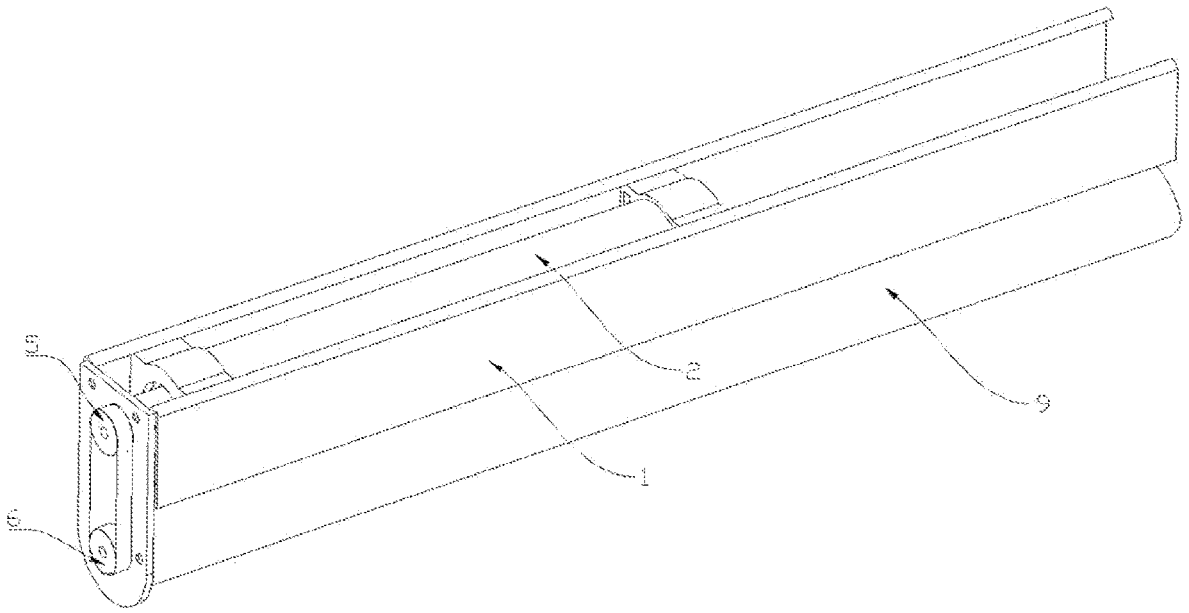
FIG. 3 is a structural schematic diagram of a pulley group as a transmission structure in the present invention.
Figure 4:
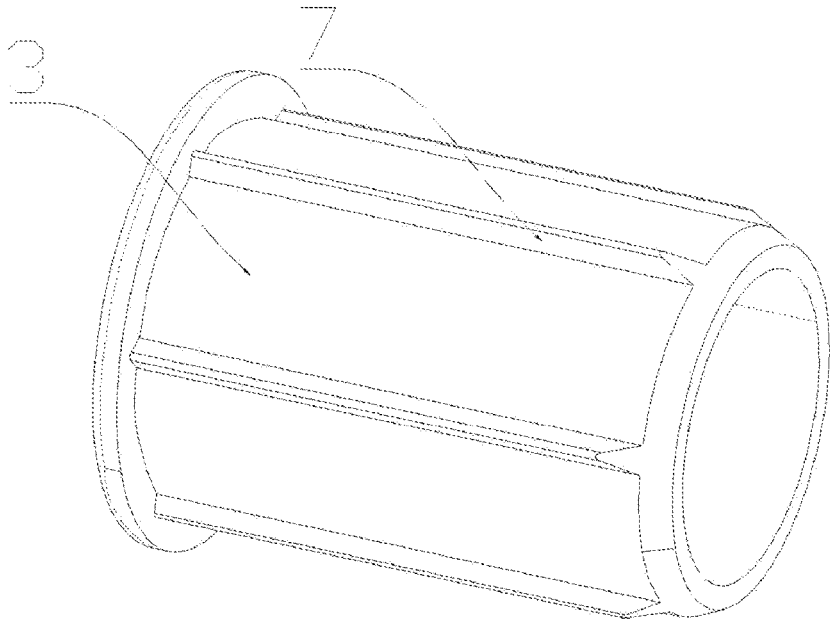
FIG. 4 is a structural schematic diagram of a pipe plug in the present invention.
Figure 5:
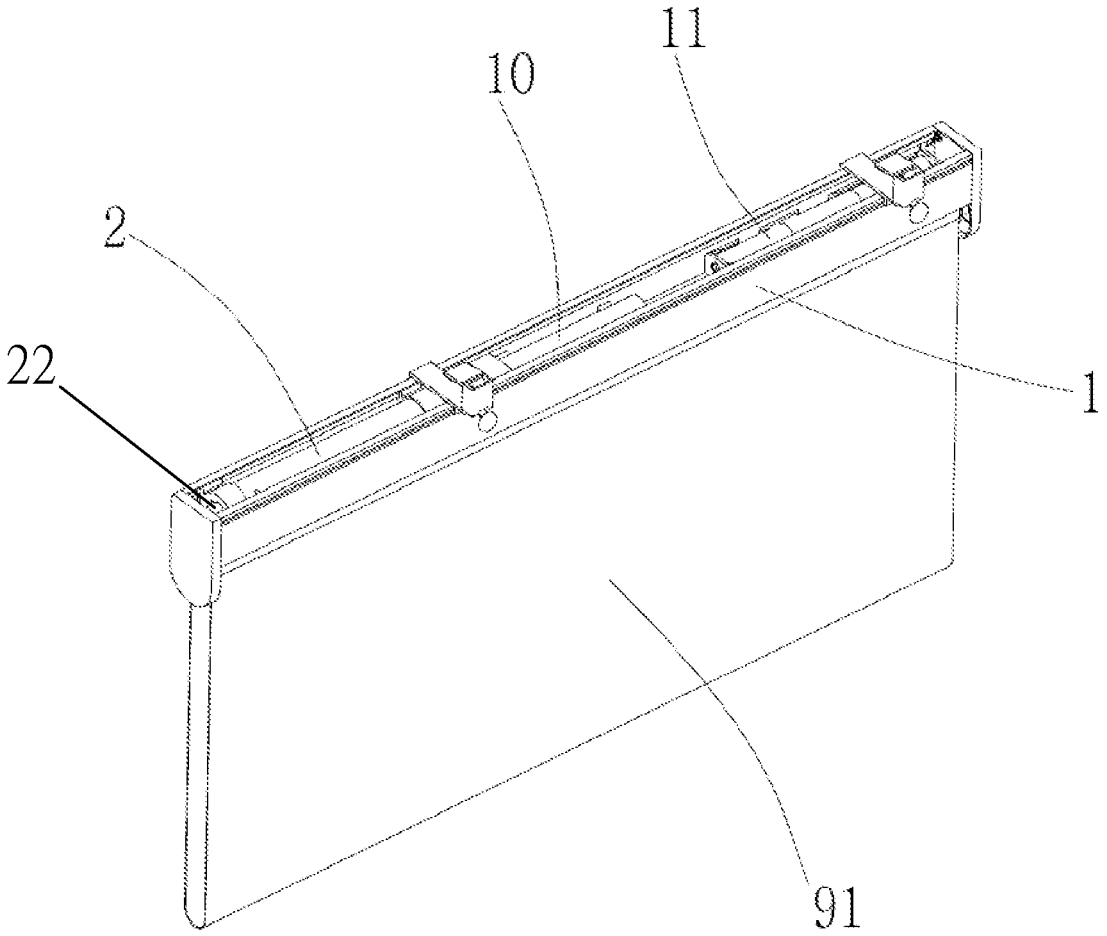
FIG. 5 is a structural schematic diagram of a transmission structure in the present invention.
Figure 6:
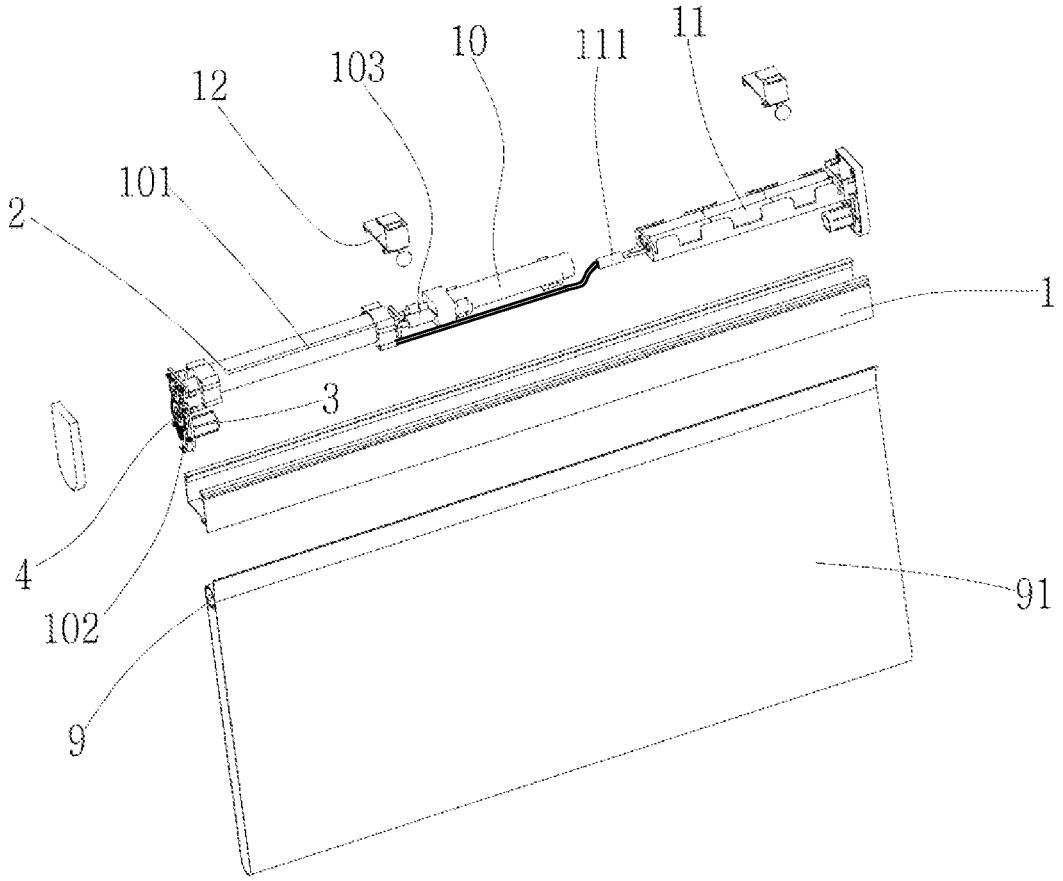
FIG. 6 is an exploded schematic diagram of a transmission structure in the present invention.

Embodiments of the present invention provide a roller blind driving device with a motor in an upper beam, as shown in FIGS. 1-6, comprising the upper beam 1 with a containing cavity, the motor 2 and a pipe coiler body 9. The motor 2 is installed in the containing cavity of the upper beam 1; an output shaft 22 of the motor 2 is in transmission connection with the pipe coiler body 9 through a transmission structure; a curtain 91 is sleeved on the pipe coiler body 9; the upper beam 1 is provided with a hanger 12; a battery for supplying power for the motor 2 is installed in the containing cavity of the upper beam 1; the battery comprises a lithium battery 10 and a dry battery 11; the lithium battery 10 is provided with an input wire 101 and a first output wire 103; the end of the input wire 101 is connected with a charging port 102; the charging port 102 is arranged on the lower part of the side plate 8; the dry battery 11 is connected with a second output wire 111; and the first output wire 103 and the second output wire 111 are connected with the motor 2 so that the lithium battery 10 and the dry battery 11 can supply power for the motor 2.

When a user selects a dry battery power supply mode structure, the dry battery 11 supplies power for the motor 1 through the second output wire 111. When the user selects a lithium battery power supply mode, the lithium battery 10 supplies power for the motor 1 through the first output wire 103.

The user adopts an external power supply for connection with the charging port 102 to complete the charging for the lithium battery 10.

The upper beam 1 is the upper beam 1 of the curtain in the installation process of a pipe coiler of the curtain, and is the existing structure. In the present invention, the installation location of the motor 2 in the prior art is improved as the interior of the containing cavity of the upper beam 1, and the motor is in transmission connection with the pipe coiler body 9 through the transmission structure, so as to apply to pipe coiler bodies 9 with various specifications. The motor 2 with single volume is adopted to reduce the cost of manufacturers.

One end of the transmission structure is connected with the output shaft of the motor 2, and the other end of the transmission structure is connected with a pipe plug 3 with a different specification; and the pipe plug 3 is coaxially connected with the pipe coiler body 9. For the convenience of installation of the pipe coiler body 9 with a different specification, the pipe plug 3 with a different specification is arranged. The pipe plug 3 with corresponding size is matched with the pipe coiler body 9 with corresponding size to realize installation of the pipe coiler body 9 with a different specification.

The transmission structure is a gear set; the gear set comprises at least two transmission gears 4, wherein one transmission gear 4 is coaxially connected with the output shaft of the motor 2, and the other transmission gear 4 is coaxially connected with the pipe coiler body 9; and adjacent transmission gears 4 are mutually engaged.

Through the arrangement of the gear set, the power of the motor 2 can be transferred to the pipe coiler body 9. Thus, the pipe coiler body 9 can be adopted to rotate, and the size of each transmission gear 4 is consistent to ensure consistent transmission ratios.

The gear set comprises more than two and an odd number of transmission gears 4; and the rotation direction of the motor 2 is the same as the rotation direction of the pipe coiler body 9 through the gear set.

The gear set can adopt an odd number of transmission gears 4 and the number of the transmission gears 4 is larger than two. In this way, the rotation direction of the motor 2 can be the same as the rotation direction of the pipe coiler body 9, which is convenient for controlling the rotation of the pipe coiler body 9 through the motor 2.

The transmission structure is a pulley group; the pulley group comprises a first pulley 5 and a second pulley 6; the first pulley 5 is coaxially connected with the output shaft of the motor 2; the second pulley 6 is coaxially connected with the pipe coiler body 9; and a belt is connected between the first pulley 5 and the second pulley 6.

The sizes of the first pulley 5 and the second pulley 6 are consistent to ensure stable transmission of the motor 2. The arrangement of the first pulley 5 and the second pulley 6 ensures that the rotation direction of the motor 2 is the same as the rotation direction of the pipe coiler body 9.

The pipe plug 3 is provided with a plurality of ribbed block bars 7 for preventing relative movement between the pipe coiler body 9 and the pipe plug 3 along a circumferential direction. The arrangement of the ribbed block bars 7 can ensure that no relative movement is generated between the pipe coiler body 9 and the pipe plug 3.

The side wall of the upper beam 1 is connected with a side plate 8; one surface of the side plate 8 is provided with the transmission structure, and the pipe plug 3 is detachably installed on another surface of the side plate 8.

The application of the present invention is as follows: the installation location of the motor 2 in the prior art is improved as the interior of the containing cavity of the upper beam 1, and the motor is in transmission connection with the pipe coiler body 9 through the transmission structure. The transmission structure includes but not limited to the gear set and the pulley group so as to apply to pipe coiler bodies 9 with various specifications. The motor 2 with single volume is adopted to reduce the cost of the manufacturers. The pipe plug 3 is detachably arranged on the side plate 8. The pipe plugs 3 with different diameters can be directly replaced to adapt to the pipe coiler bodies 9 with different sizes. The replacement is convenient and the applicability is wide.

For those skilled in the art, apparently, the present invention is not limited to details of the above demonstrative embodiments. Moreover, the present invention can be realized in other specific forms without departing from the spirit or basic feature of the present invention. Therefore, in all respects, the embodiments shall be regarded to be demonstrative and nonrestrictive. The scope of the present invention is defined by appended claims, rather than the above description. Therefore, the present invention is intended to include all changes falling into the meaning and the scope of equivalent elements of claims within the present invention. Any drawing mark in claims shall not be regarded to limit the concerned claims.

In addition, it shall be understood that although the description is explained in accordance with the embodiments, not every embodiment only includes one independent technical solution. This narration mode of the description is only for clarity. Those skilled in the art shall regard the description as a whole, and the technical solution in each embodiment can also be appropriately combined to form other embodiments understandable for those skilled in the art.

What is claimed is:

1. A roller blind driving device with a motor in an upper beam, comprising the upper beam (1) with a containing cavity, the motor (2) and a pipe coiler body (9), wherein the motor (2) is installed in the containing cavity of the upper beam (1); an output shaft (22) of the motor (2) is in transmission connection with the pipe coiler body (9) through a transmission structure; batteries for supplying power for the motor (2) are installed in the containing cavity of the upper beam (1) characterized in that the batteries comprise a lithium battery (10) and a dry-cell battery (11); the lithium battery (10) is provided with an input wire (101) and a first output wire (103); an end of the input wire (101) is connected with a charging port (102); the dry-cell battery (11) is connected with a second output wire (111); the first output wire (103) and the second output wire (111) are connected with the motor (2); and the motor is powered by either the lithium battery (10) or the dry-cell battery (11); the lithium battery (10) and the dry-cell battery (11) are simultaneously provided in the containing cavity of the upper beam (1) and power the motor (2) from different energy sources; wherein a side wall of the upper beam (1) is connected with a side plate (8); one surface of the side plate (8) is provided with the transmission structure, and a pipe plug (3) is detachably installed on another surface of the side plate (8) wherein the pipe plug (3) is provided with a plurality of ribbed block bars (7) for preventing relative movement between the pipe coiler body (9) and the pipe plug (3) along a circumferential direction and the charging port (102) is arranged on a lower part of the side plate (8).

2. The roller blind driving device with the motor in the upper beam according to claim 1, wherein one end of the transmission structure is connected with the output shaft (22) of the motor (2), and the other end of the transmission structure is connected with the pipe plug (3); and the pipe plug (3) is coaxially connected with the pipe coiler body (9).

3. The roller blind driving device with the motor in the upper beam according to claim 1, wherein the transmission structure is a gear set; the gear set comprises at least two transmission gears (4), wherein one transmission gear (4) is coaxially connected with the output shaft of the motor (2), and another transmission gear (4) is coaxially connected with the pipe coiler body (9); and adjacent transmission gears (4) are mutually engaged.

4. The roller blind driving device with the motor in the upper beam according to claim 3, wherein the gear set comprises more than two and an odd number of transmission gears (4); and the rotation direction of the motor (2) is the same as the rotation direction of the pipe coiler body (9) through the gear set.

5. The roller blind driving device with the motor in the upper beam according to claim 1, wherein the transmission structure is a pulley group; the pulley group comprises a first pulley (5) and a second pulley (6); the first pulley (5) is coaxially connected with the output shaft of the motor (2); the second pulley (6) is coaxially connected with the pipe coiler body (9); and a belt is connected between the first pulley (5) and the second pulley (6).

* * * * *